United States Patent [19]

Goguen

[11] Patent Number: 4,972,972

[45] Date of Patent: Nov. 27, 1990

[54] PORTABLE FUEL DISPENSING CONTAINER

[76] Inventor: Daniel J. Goguen, P.O. Box 48, Scoudouc, New Brunswick, Canada, E0A 1N0

[21] Appl. No.: 406,029

[22] Filed: Sep. 11, 1989

[51] Int. Cl.[5] ..... B67D 5/60

[52] U.S. Cl. ..... 222/130; 222/396; 222/401; 222/465.1; 222/529; 222/530; 222/538

[58] Field of Search ..... 222/129, 130, 396, 401, 222/465.1, 529, 530, 538, 481; 239/373, 360, 195; 220/20, 20.5

[56] References Cited

U.S. PATENT DOCUMENTS

| | | | |
|---|---|---|---|
| 523,951 | 7/1894 | Van Fleet | 222/396 X |
| 783,237 | 2/1905 | Baker | 222/396 |
| 2,151,069 | 3/1939 | Bahr | 222/530 X |
| 2,550,157 | 4/1951 | Mazza | 222/530 X |
| 2,645,381 | 7/1953 | Lattman | 222/401 X |
| 2,723,056 | 11/1955 | Smith | 222/396 |
| 3,064,673 | 11/1962 | Rockwell | 222/396 X |
| 3,260,463 | 7/1966 | Giovansanti et al. | 239/373 X |
| 4,236,655 | 12/1980 | Humphries | 222/465.1 |
| 4,266,693 | 5/1981 | Pfeiffer | 222/530 X |
| 4,416,396 | 11/1983 | Ward | 222/530 X |
| 4,781,314 | 11/1988 | Schoonover et al. | 222/465.1 |
| 4,819,833 | 4/1989 | Huddlestone et al. | 222/130 X |
| 4,863,075 | 9/1989 | Romer | 222/401 X |

*Primary Examiner*—Andres Kashnikow
*Assistant Examiner*—Gregory L. Huson
*Attorney, Agent, or Firm*—Leon Gilden

[57] ABSTRACT

A portable fuel dispensing container is defined by an elongate enclosed housing formed with a first forward wall spaced from a second forward wall defining a hose chamber forwardly of a fuel chamber. The container includes a pressured discharge cap positioning rearwardly through a top wall of the container with a pressurizing jump positioned through the top wall of the container adjacent the second chamber. A rigid hose includes a horizontal leg positioned within the fuel chamber, and a verical leg directed through the forward wall of the container and extending upwardly therealong terminating in a coupling for securement to a flexible hose. The flexible hose includes a discharge nozzle at a free end thereof to enable remote filling and discharge of fuel contained within the fuel chamber when pressurized.

2 Claims, 1 Drawing Sheet

PORTABLE FUEL DISPENSING CONTAINER

BACKGROUND OF THE INVENTION

1. Field of the Invention

The field of invention relates to fuel containers, and more particularly pertains to a new and improved portable fuel dispensing container wherein the same enables remote discharge of fuel contained within the container.

2. Description of the Prior Art

The use of fuel containers is well known in the prior art. These containers are a convenient and portable means of transporting fuel. The fuel contained within such a container in any sufficient quantity has properties such as weight and bulk inconvenient to many individuals for continuous portage and transport. Typically when a fuel container is of a convenient size for transport, sufficient quantities of fuel are not available in reservoir storage within the container. Examples of the prior art include U.S. Pat. No. 4,632,268 to Melzi setting forth the use of a portable container utilized for the reception of crank case oil for underlying an automobile during a drainage procedure. The container includes a convex side with a threaded screw cap removable therewithin for reception of the oil within the container.

U.S. Pat. No. D. 212,089 to Pelfer; U.S. Pat No. D. 196,272 to Gran; U.S. Pat. No. D. 190,773 to Koch; and U.S. Pat. No. D. 51,545 to Blake are illustrative of various fluid containers utilized throughout the prior art that contain and provide reservoirs for various fluids within the containers.

As such, it may be appreciated that there is a continuing need for a new and improved portable fuel dispensing container which addresses both the problems of effectiveness in storage and ease of dispensing subsequent to storage of a petroleum fluid and in this respect, the present invention substantially fulfills this need.

SUMMARY OF THE INVENTION

In view of the foregoing disadvantages inherent in the known types of fuel dispensing containers now present in the prior art, the present invention provides a portable fuel dispensing container wherein the same provides for the pressurized dispensing of fuel contained within the container subsequent to storage of the fuel. As such, the general purpose of the present invention, which will be described subsequently in greater detail, is to provide a new and improved portable fuel dispensing container which has all the advantages of the prior art fuel storage containers and none of the disadvantages.

To attain this, the present invention includes a fuel storage container defining elongate planar sides, each formed with reinforcing depressions formed therein to avoid unnecessary flexure within the side walls of the container, with a top wall formed with towers at either end spaced above an intermediate portion with a handle secured between the towers. A rear tower of the top wall includes a vented pressurized threaded cap arranged to discharge vapors from within the container at a predetermined pressure with a forward tower of the top wall of the container, including a pressurizing pump to pressurize the confined fuel chamber defined with the container. The container further includes a first forward wall and a spaced second forward wall interconnected at their sides by extensions of the side wall, wherein the side wall extensions and the second forward wall define an upper perimeter of a height less than that of the forward tower to provide access to a coupling member terminating a vertical leg of an "L" shaped discharge rigid hose directed interiorly overlying the floor of the container. Flexible hose is securable to the container and is positionable within the forward storage portion of the container during periods of non-use and is extensible and formed with a discharge nozzle for remote discharge of fuel contained within the fuel chamber in the container.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved portable fuel dispensing container which has all the advantages of the prior art fuel containers and none of the disadvantages.

It is another object of the present invention to provide a new and improved portable fuel dispensing container which may be easily and efficiently manufactured and marketed.

It is a further object of the present invention to provide a new and improved portable fuel dispensing container which is of a durable and reliable construction.

An even further object of the present invention is to provide a new and improved portable fuel dispensing container which is susceptible of a low cost of manufacture with regard &o both materials and labor, and which accordingly is then susceptible of low prices of sale to the consuming public, thereby making such portable fuel dispensing containers economically available to the buying public.

Still yet another object of the present invention is to provide a new and improved portable fuel dispensing container which provides in the apparatuses and methods of the prior art some of the advantages thereof, while simultaneously overcoming some of the disadvantages normally associated therewith.

Still another object of the present invention is to provide a new and improved portable fuel dispensing container including a forward storage compartment aligned with the container for containing of a fuel discharging hose operably associated with the fuel container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
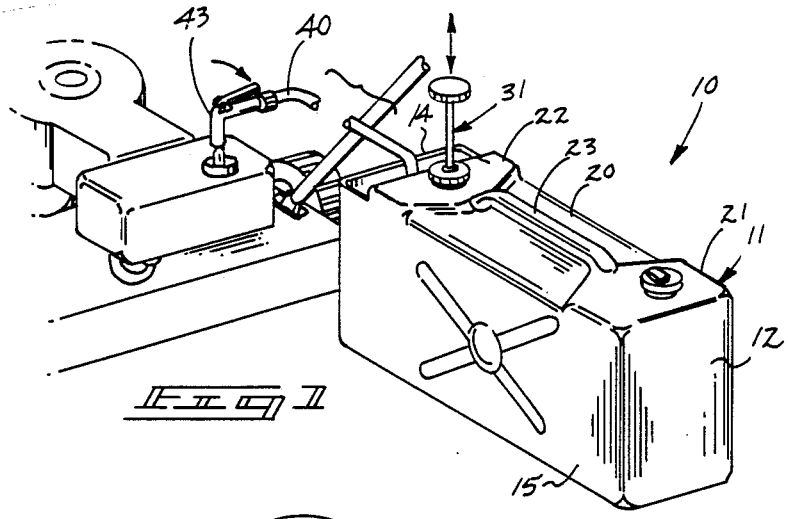
FIG. 1 is an isometric illustration of the instant invention.

With reference now to the drawings, and in particular to FIGS. 1 to 5 thereof, a new and improved portable fuel dispensing container embodying the principles and concepts of the present invention and generally designated by the reference numeral 10 will be described.

More specifically, the portable fuel dispensing container 10 essentially comprises a rigid container 11 including a rear wall 12 of a predetermined rectangular configuration and height spaced from a first forward wall 13 of an equal rectangular configuration to the rear wall 12, with a second forward wall 14 spaced forwardly and parallel to the first forward wall 13 of a height less than that defined by the rear and forward walls 12 and 18. Spaced parallel side walls 15 interconnect the rear wall and forward walls, wherein the side walls 15 formed between the first and second forward walls 13 and 14 is of a height equal to that of the second forward wall 14 but less than that defined by the rear wall 12 or the first forward wall 13. The container further includes a top wall 20 extending between the rear wall 12 and the first forward wall 13 and is formed with a central portion positioned medially of a rear top wall tower 21 and a forward top wall tower 22. A handle 23 is integrally formed to the rear and forward towers 21 and 22 respectively. The top wall 20 in association with the rear wall 12 and first forward wall 13 formed between the side walls 15 underlying a coextensive floor between the rear and second forward walls defines a fuel chamber 16 therewithin, wherein a hose storage chamber 17 is defined between the first forward wall 13 and the second forward wall 14 between the side walls 15. A drainage aperture 18 is positioned medially within the floor portion of the hose storage chamber 17 to provide convenient drainage of fuels and fluids inadvertently received within the hose storage chamber 17. It should be further noted that the side walls 15, due to their elongate expanse and of a geometric configuration substantially greater than that defined by the rear and forward walls, include reinforcing depressions comprising cross reinforcing depressions 19 diametrically aligned with a central circular depression **19*a***, as illustrated.

Figure 5:
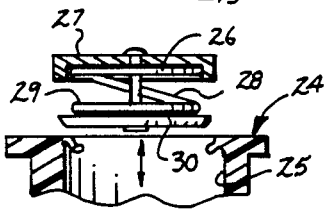
FIG. 5 is an orthographic cross-sectional view taken along the lines 5—5 of FIG. 2 in the direction indicated by the arrows.

A threaded fill cap 24 is orthogonally directed overlying associated aperture of the rear tower 21 and is securable over a cylindrical well 25 coaxially formed about the central cap aperture 26. A pressure relief cap 27 overlies the top wall of the fill cap 24 and is formed with a central rod 28 coaxially directed through the cylindrical well 25 and connected to a pressure plate 30 with a captured spring 29 secured between the plate 30 and the underlying surface of the top wall of the fill cap 24, as illustrated in FIG. 5. Typically, the captured spring 29 and associated plate 30 is arranged to enable venting of the fuel chamber 16 upon a pressure within the fuel chamber 16 attaining a five pounds per square inch or greater pressure level upon pressurizing of the fuel chamber 16 to be discussed below.

A pressurizing pump 31 is threadedly mountable medially of the forward tower 22 and includes an internally threaded cap 32 to overlie and secure the pump 31 to an associated pump aperture within the forward tower with a reciprocatable ram 33 coaxially aligned with the cap 32 formed with a grasp handle at its upper end and a piston **33*a*, at its lower end reciprocatable within a cylindrical chamber 34 coaxially aligned and extending downwardly relative to the cap 32. A first check valve 35 is positioned within the cap 32 to permit air to be received interiorly of the cylindrical chamber 34, with a second check valve 36 formed within the piston 33*a* to direct air downwardly between the piston 33*a* and a floor of the cylindrical chamber 34, with a third check valve 37 formed through the floor of the cylindrical chamber 34 to permit pressurized air captured between the piston 33*a* and the floor of the chamber 34 to be directed interiorly of the fuel chamber 16** to pressurize the same.

Figure 2:
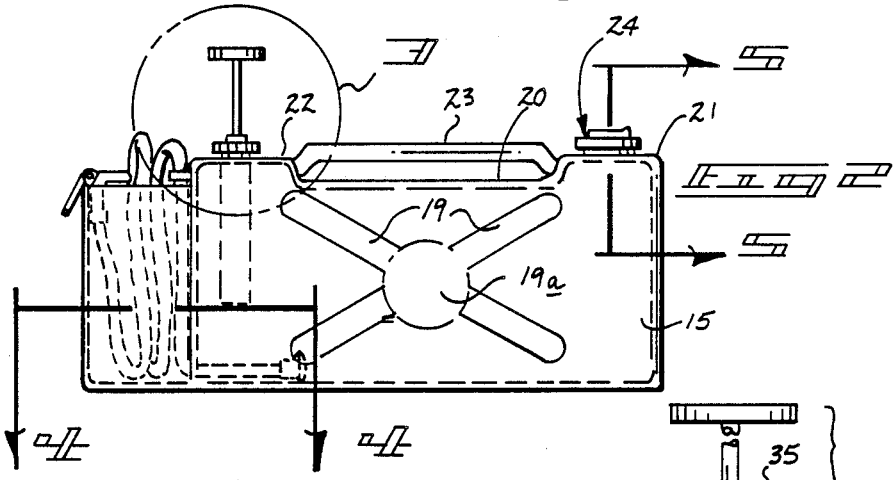
FIG. 2 is an orthographic side view taken in elevation of the instant invention.
Figure 4:
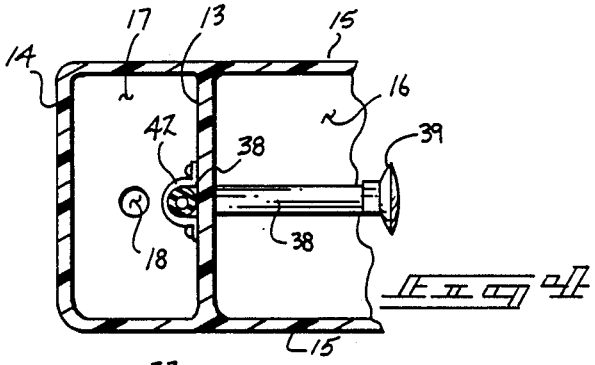
FIG. 4 is an orthographic cross-sectional view taken along the lines 4—4 of FIG. 2 in the direction indicated by the arrows.
Figure 3:
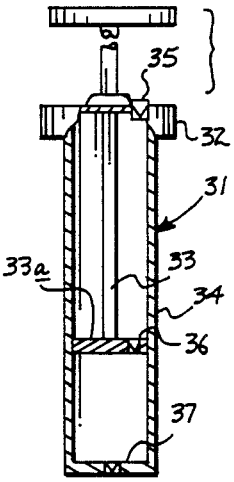
FIG. 3 is an orthographic cross-sectional view of the pressurizing pump, as indicated in FIG. 2.

An "L" shaped rigid tube 38 originates interiorly and extends along the floor of the container 11 formed with a filter screen head 39 to receive pressurized fuel within the horizontal leg of the rigid tube 38, with the rigid tube extending through a bottom portion of the first forward wall 13 and extending vertically upwardly adjacent the first forward wall 13 and terminating in a coupling 41 at its upper end. A "U" shaped clamp 42 secures the vertical leg of the "L" shaped tube 38 against an exterior surface of the first forward wall, as illustrated in FIGS. 2 and 4 for example. An elongate flexible hose 40 is securable to the rigid tube 38 by way of the coupling 41 and is of a predetermined length defined by at least three feet or greater and terminates in a lever actuatable discharge nozzle 43 to enable directing of pressurized fuel contained within the fuel chamber 16 to a desired remote receptacle, such as illustrated in FIG. 1.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the U.S. is as follows:

1. A portable fuel dispensing container for storage and selective discharge of fuel contained within the container comprising, a container body including a bottom wall spaced from and parallel to a top wall, a real wall, elongate side walls, and a first wall spaced from and parallel to the rear wall and a second forward wall spaced from and parallel to the first forward wall, and a cap member threadedly mounted to the top wall overlying a first aperture within the top wall, a pressurizing pump assembly directed through a second aperture in the top wall spaced from the first aperture, and a fuel chamber defined between the rear wall and first forward wall, and a hose storage chamber defined between the first forward wall and the second forward wall, and a hose means including a manually operative discharge nozzle and an input hose for directing fuel from the chamber through the discharge nozzle subsequent to pressurizing the fuel chamber by the pump member, and wherein the hose storage chamber includes a drainage aperture directed through the bottom wall positioned between the first forward wall and second forward wall, and wherein the elongate side walls defined between the first forward wall and second forward wall are of a predetermined height, and the rear wall and first forward wall of a further predetermined height greater than the predetermined height, and wherein the top wall includes a rear tower portion adjacent the rear wall and a forward tower portion adjacent the forward wall, each including planar surfaces spaced above a medial portion of the top wall defined between the forward and rear towers, and a handle integrally joined to confronting edge portions of the forward tower and rear tower overlying the medial portion of the top wall, and the first aperture directed through the rear tower and the second aperture directed through the forward tower, and wherein the cap member includes a pressure venting arrangement including an overlying cap overlying a top wall of the cap member and a cap aperture, and a cylindrical well directed downwardly coaxially arranged about the cap aperture underlying the overlying cap, wherein the overlying cap includes a central rod extending coaxially of the cap aperture and the cylindrical well and terminating at its lower end in a plate member with a captured spring secured between the bottom surface of the cap and the top surface of the plate, and the captured spring displaceable upon pressurization within the fuel chamber to equal or exceed five pounds per square inch, and wherein the pressurizing pump member includes a threaded cap portion threadedly securable about the second aperture and includes a reciprocating ram reciprocatable relative to a cylindrical chamber underlying the cap portion, and the reciprocating ram including a handle grasp member at its upper end extending above the cap portion and includes a piston secured at its other end in sealing relationship interiorly of the cylindrical chamber, and a first check valve formed through the cap portion, a second check valve formed through the piston, and the cylindrical chamber terminating in a floor at its lower end remote from the cap portion and including a third check valve directed therethrough to enable pressurizing of the fuel chamber, and wherein the input hose includes a rigid "L" shaped hose including a horizontal leg directed interiorly of the fuel chamber adjacent the bottom wall and terminating in a filtering head interiorly of the fuel chamber, and the rigid hose extending through the first forward wall at a bottom portion thereof adjacent the floor and extending adjacent the first forward wall within the hose storage chamber and including a clamp member to contain the vertical leg of the rigid hose adjacent the first forward wall, and the vertical leg terminating at its upper end in a coupling member spaced above an upper terminal end of the second forward wall and spaced below a top surface of the forward tower.

2. A portable fuel dispensing container as set forth in claim 1 wherein the hose means includes an elongate flexible hose secured to the rigid hose at the coupling and terminating at its free end in the manually operative discharge nozzle.

* * * * *